US011603849B2

(12) United States Patent
Futagi

(10) Patent No.: US 11,603,849 B2
(45) Date of Patent: Mar. 14, 2023

(54) TURBO-MOLECULAR PUMP, ROTOR AND STATOR

(71) Applicant: SHIMADZU CORPORATION, Kyoto (JP)

(72) Inventor: Keiichi Futagi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 9 days.

(21) Appl. No.: 17/307,030

(22) Filed: May 4, 2021

(65) Prior Publication Data

US 2021/0381516 A1 Dec. 9, 2021

(30) Foreign Application Priority Data

Jun. 3, 2020 (JP) ..... JP2020-097271

(51) Int. Cl.
*F04D 19/04* (2006.01)
*F04D 29/18* (2006.01)

(52) U.S. Cl.
CPC ..... *F04D 19/042* (2013.01); *F04D 29/181* (2013.01)

(58) Field of Classification Search
CPC ..... F04D 19/042; F04D 19/04; F04D 19/324; F04D 19/02; F04D 19/028
See application file for complete search history.

(56) References Cited

U.S. PATENT DOCUMENTS 5,358,373 A * 10/1994 Hablanian ..... F04D 29/542 415/199.5
5,577,881 A * 11/1996 Hablanian ..... F04D 17/168 415/55.1
6,499,942 B1 * 12/2002 Nonaka ..... F04D 29/324 416/243
7,588,417 B2 * 9/2009 Maniglier ..... F04D 29/644 415/199.5
10,024,327 B2 * 7/2018 Tsutsui ..... F04D 19/042
2005/0220606 A1 * 10/2005 Beyer ..... F04D 29/324 415/90
2012/0148390 A1 * 6/2012 Hsu ..... F04D 19/042 415/199.5
2012/0207592 A1 * 8/2012 Tsutsui ..... F04D 19/042 415/200

FOREIGN PATENT DOCUMENTS

JP 2000-161285 A 6/2000

OTHER PUBLICATIONS

Office Action for corresponding TW Application No. 110109473 dated Oct. 4, 2021, with machine translation.

* cited by examiner

*Primary Examiner* — J. Todd Newton
*Assistant Examiner* — Behnoush Haghighian
(74) *Attorney, Agent, or Firm* — Renner, Otto, Boisselle & Sklar, LLP

(57) ABSTRACT

A turbo-molecular pump comprises multiple stages of rotor blades and multiple stages of stator blades. When m is a positive real number equal to or less than a total number of stages of the rotor blades and greater than one and K is a natural number which is not a multiple of m in a case where m is a natural number and is a natural number in a case where m is not the natural number, the multiple stages of the rotor blades include a rotor blade at an inter-blade angle α1, and a rotor blade of which reference position is phase-shifted from a reference position of the rotor blade at the inter-blade angle α1 by an angle α1·K/m.

13 Claims, 10 Drawing Sheets

FIG. 9

| SHIFT APPLIED BLADE | SHIFT METHOD | RATE OF IMPROVEMENT OF PERFORMANCE |
|---|---|---|
| ROTOR BLADE | 1/2 PITCH SHIFT | 2. 9% |
| STATOR BLADE | 1/2 PITCH SHIFT | 7. 1% |
| ROTOR BLADE + STATOR BLADE | 1/2 PITCH SHIFT | 11 7% |
| ROTOR BLADE | 1/3 PITCH SHIFT | 13. 4% |
| STATOR BLADE | 1/3 PITCH SHIFT | 4. 0% |
| ROTOR BLADE + STATOR BLADE | 1/3 PITCH SHIFT | 16. 2% |

FIG. 10

(RATE OF IMPROVEMENT OF PERFORMANCE)

| MODEL | R BLADE: 1/3 PITCH SHIFT | R BLADE + S BLADE: 1/3 PITCH SHIFT |
|---|---|---|
| 2000 L/s CLASS | 9. 1% | 11. 2% |
| 3000 L/s CLASS | 10. 8% | 14. 2% |
| 4000 L/s CLASS | 13. 4% | 16. 2% |
| 7000 L/s CLASS | 13. 0% | 12. 4% |

TURBO-MOLECULAR PUMP, ROTOR AND STATOR

BACKGROUND OF THE INVENTION

1. Technical Field

The present invention relates to a turbo-molecular pump.

2. Background Art

A turbo-molecular pump rotates, at high speed, rotor blades formed with turbine blades relative to stator blades formed with turbine blades, thereby discharging gas molecules having flowed in through a suction port of the pump from an exhaust port of the pump. The multiple stages of the stator blades and the multiple stages of the rotor blades formed at a pump rotor are alternately arranged in a rotor axis direction. The turbine blade provides a momentum for moving to an exhaust downstream side to the gas molecule having collided with the turbine blade, and the gas molecule moves to the exhaust downstream side accordingly. Then, the gas molecule is discharged from the exhaust port of the pump.

It is assumed that under high-vacuum conditions, there is almost no intermolecular collision while the gas molecule is passing through a single turbine blade stage. Thus, most of backflow molecules flowing from an exhaust side to a suction side are bounced on the turbine blades, and performance degradation due to the backflow molecules is not necessarily taken into consideration much. However, under high-flow-rate high-back-pressure conditions, the intermolecular collision increases while the gas molecule is passing through the single turbine blade stage, and influence of a backflow of the gas molecule become noticeable. This causes a problem that exhaust performance is degraded. Thus, in a turbo-molecular pump described in Patent Literature 1 (JP-A-2000-161285), the shapes of a rotor blade and a stator blade are such shapes that a backflow prevention effect is provided, and in this manner, the influence of the backflow is reduced.

SUMMARY OF THE INVENTION

However, in the turbo-molecular pump described in Patent Literature 1, the blade shape is such a complicated shape that blade inclination changes from a suction side to an exhaust side. Thus, it is difficult to perform blade processing, and a problem that a processing cost increases is caused. Moreover, turbine blades are formed radially from a center axis, and therefore, a clearance is easily formed between adjacent ones of the turbine blades in a circumferential direction on an outer diameter side. Under the high-flow-rate high-back-pressure conditions, influence of the clearance relating to the backflow cannot be ignored.

A turbo-molecular pump comprises: multiple stages of rotor blades formed with multiple blades and provided in a rotor axis direction; and multiple stages of stator blades formed with multiple blades, the multiple stages of the stator blades and the multiple stages of the rotor blades being alternately arranged in the rotor axis direction. When m is a positive real number equal to or less than a total number of stages of the rotor blades and greater than one and K is a natural number which is not a multiple of m in a case where m is a natural number and is a natural number in a case where m is not the natural number, the multiple stages of the rotor blades include a rotor blade at an inter-blade angle $\alpha 1$, and a rotor blade of which reference position is phase-shifted from a reference position of the rotor blade at the inter-blade angle $\alpha 1$ by an angle $\alpha 1 \cdot K/m$.

When n is a positive real number equal to or less than a total number of stages of the stator blades and greater than one and L is a natural number which is not a multiple of n in a case where n is a natural number and is a natural number in a case where n is not the natural number, the multiple stages of the stator blades include a stator blade at an inter-blade angle $\alpha 2$, and a stator blade of which reference position is phase-shifted from a reference position of the stator blade at the inter-blade angle $\alpha 2$ by an angle $\alpha 2 \cdot L/n$.

A turbo-molecular pump comprises: multiple stages of rotor blades formed with multiple blades and provided in a rotor axis direction; and multiple stages of stator blades formed with multiple blades, the multiple stages of the stator blades and the multiple stages of the rotor blades being alternately arranged in the rotor axis direction. When n is a positive real number equal to or less than a total number of stages of the stator blades and greater than one and L is a natural number which is not a multiple of n in a case where n is a natural number and is a natural number in a case where n is not the natural number, the multiple stages of the stator blades include a stator blade at an inter-blade angle $\alpha 2$, and a stator blade of which reference position is phase-shifted from a reference position of the stator blade at the inter-blade angle $\alpha 2$ by an angle $\alpha 2 \cdot L/n$.

When the total number of stages of the rotor blades is M, a one-end-side stage of the multiple stages of the rotor blades is taken as a first stage of the rotor blade, and an other-end-side stage of the rotor blade is taken as an M-th stage of the rotor blade, the first stage of the rotor blade and a k1-th stage of the rotor blade that $(k1-1)$ is a multiple of m are set as the rotor blade at the inter-blade angle $\alpha 1$, and a k1-th stage of the rotor blade that $(k1-1)$ is not the multiple of m is set as a rotor blade phase-shifted by an angle $\alpha 1 \cdot (k1-1)/m$.

When the total number of stages of the stator blades is N, a one-end-side stage of the multiple stages of the stator blades is taken as a first stage of the stator blade, and an other-end-side stage of the stator blade is taken as an N-th stage of the stator blade, the first stage of the stator blade and a k2-th stage of the stator blade that $(k2-1)$ is a multiple of n are set as the stator blade at the inter-blade angle $\alpha 2$, and a k2-th stage of the stator blade that $(k2-1)$ is not the multiple of n is set as a stator blade phase-shifted by an angle $\alpha 2 \cdot (k2-1)/n$.

The turbo-molecular pump further comprises: multiple spacer rings provided such that the spacer rings and the multiple stages of the stator blades are alternately stacked on each other in the pump axis direction. Each spacer ring has a position adjustment member configured to adjust the reference position of each stator blade.

A rotor in a turbo-molecular pump; the turbo-molecular pump comprising the rotor including the multiple stages of rotor blades formed with multiple blades and provided in a rotor axis direction and a stator including multiple stages of stator blades formed with multiple blades, the multiple stages of the stator blades and the multiple stages of the rotor blades being alternately arranged in the rotor axis direction; wherein when m is a positive real number equal to or less than a total number of stages of the rotor blades and greater than one and K is a natural number which is not a multiple of m in a case where m is a natural number and is a natural number in a case where m is not the natural number, the multiple stages of the rotor blades include a rotor blade at an inter-blade angle $\alpha 1$, and a rotor blade of which reference position is phase-shifted from a reference position of the rotor blade at the inter-blade angle α1 by an angle α1·K/m.

A stator in a turbo-molecular pump; the turbo-molecular pump comprising a rotor including the multiple stages of rotor blades formed with multiple blades and provided in a rotor axis direction and the stator including multiple stages of stator blades formed with multiple blades, the multiple stages of the stator blades and the multiple stages of the rotor blades being alternately arranged in the rotor axis direction; wherein when n is a positive real number equal to or less than a total number of stages of the stator blades and greater than one and L is a natural number which is not a multiple of n in a case where n is a natural number and is a natural number in a case where n is not the natural number, the multiple stages of the stator blades include a stator blade at an inter-blade angle α2, and a stator blade of which reference position is phase-shifted from a reference position of the stator blade at the inter-blade angle α2 by an angle α2·L/n.

According to the present invention, the backflow can be reduced, and the exhaust performance can be improved.

BRIEF DESCRIPTION OF THE DRAWINGS

FIG. 9 shows a table for describing the rate of improvement of exhaust performance in a case where phase shift was applied to a rotor blade and a stator blade of an existing 4000-L/s-class turbo-molecular pump; and FIG. 10 shows a table for describing the rate of improvement of the exhaust performance in a case where the phase shift was applied to an existing 2000-L/s to 7000-L/s-class turbo-molecular pump.

DETAILED DESCRIPTION OF THE EXEMPLARY EMBODIMENTS

Figure 1:
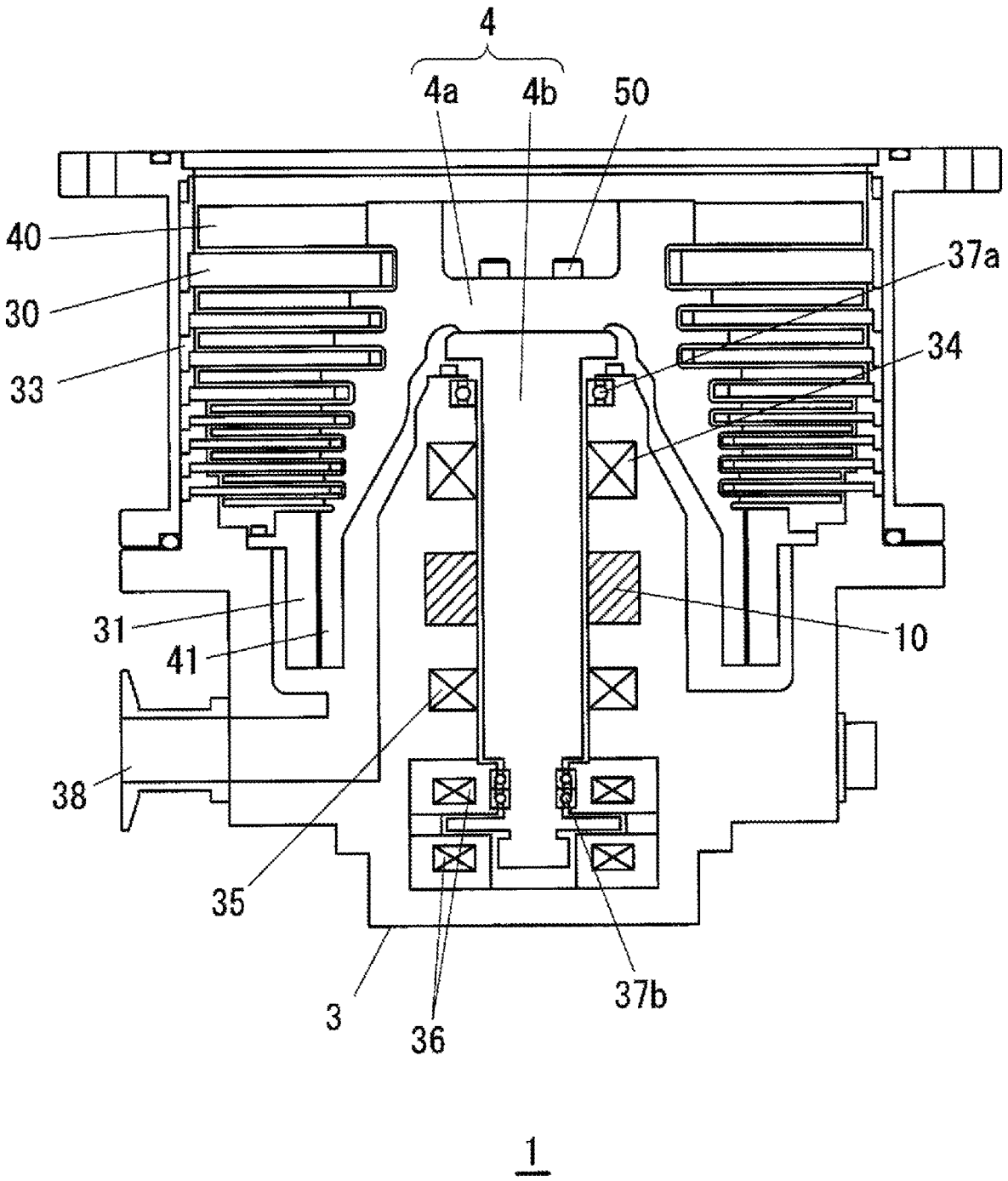
FIG. 1 shows a schematic sectional view of an outline configuration of a turbo-molecular pump.

Hereinafter, an embodiment of the present invention will be described with reference to the figures. FIG. 1 shows a schematic sectional view of an outline configuration of a turbo-molecular pump 1. Note that a magnetic bearing type turbo-molecular pump will be described as an example in the present embodiment, but the present invention is not limited to the magnetic bearing type and is applicable to various turbo-molecular pumps.

The turbo-molecular pump 1 has a turbo pump stage including multiple stages of stator blades 30 and multiple stages of rotor blades 40 and a screw groove pump stage including a stator 31 and a cylindrical portion 41. In an example shown in FIG. 1, the turbo pump stage includes eight stages of the stator blades 30 and nine stages of the rotor blades 40, but the number of stages is not limited to above. In the screw groove pump stage, a screw groove is formed at the stator 31 or the cylindrical portion 41. The rotor blades 40 and the cylindrical portion 41 are formed at a pump rotor 4*a*. The pump rotor 4*a* is fastened to a shaft 4*b* as a rotor shaft with multiple bolts 50. The pump rotor 4*a* and the shaft 4*b* are integrally fastened with the bolts 50, thereby forming a rotary body 4.

The multiple stages of the stator blades 30 and the multiple stages of the rotor blades 40 provided in an axial direction of the pump rotor 4*a* are alternately arranged. Each stator blade 30 is stacked in a pump axial direction through a spacer ring 33. The shaft 4*b* is magnetically levitated and supported by magnetic bearings 34, 35, 36 provided at a base 3. Although not shown in detail in the figure, each of the magnetic bearings 34 to 36 includes an electromagnet and a displacement sensor. A levitation position of the shaft 4*b* is detected by the displacement sensors.

The rotary body 4 configured such that the pump rotor 4*a* and the shaft 4*b* are fastened with the bolts is rotatably driven by a motor 10. When the magnetic bearings are not in operation, the shaft 4*b* is supported by emergency mechanical bearings 37*a*, 37*b*. When the rotary body 4 is rotated at high speed by the motor 10, gas on a pump suction port side is sequentially discharged by the turbo pump stage (the rotor blades 40, the stator blades 30) and the screw groove pump stage (the cylindrical portion 41, the stator 31), and is discharged through an exhaust port 38. An auxiliary pump is connected to the exhaust port 38.

Figure 2:
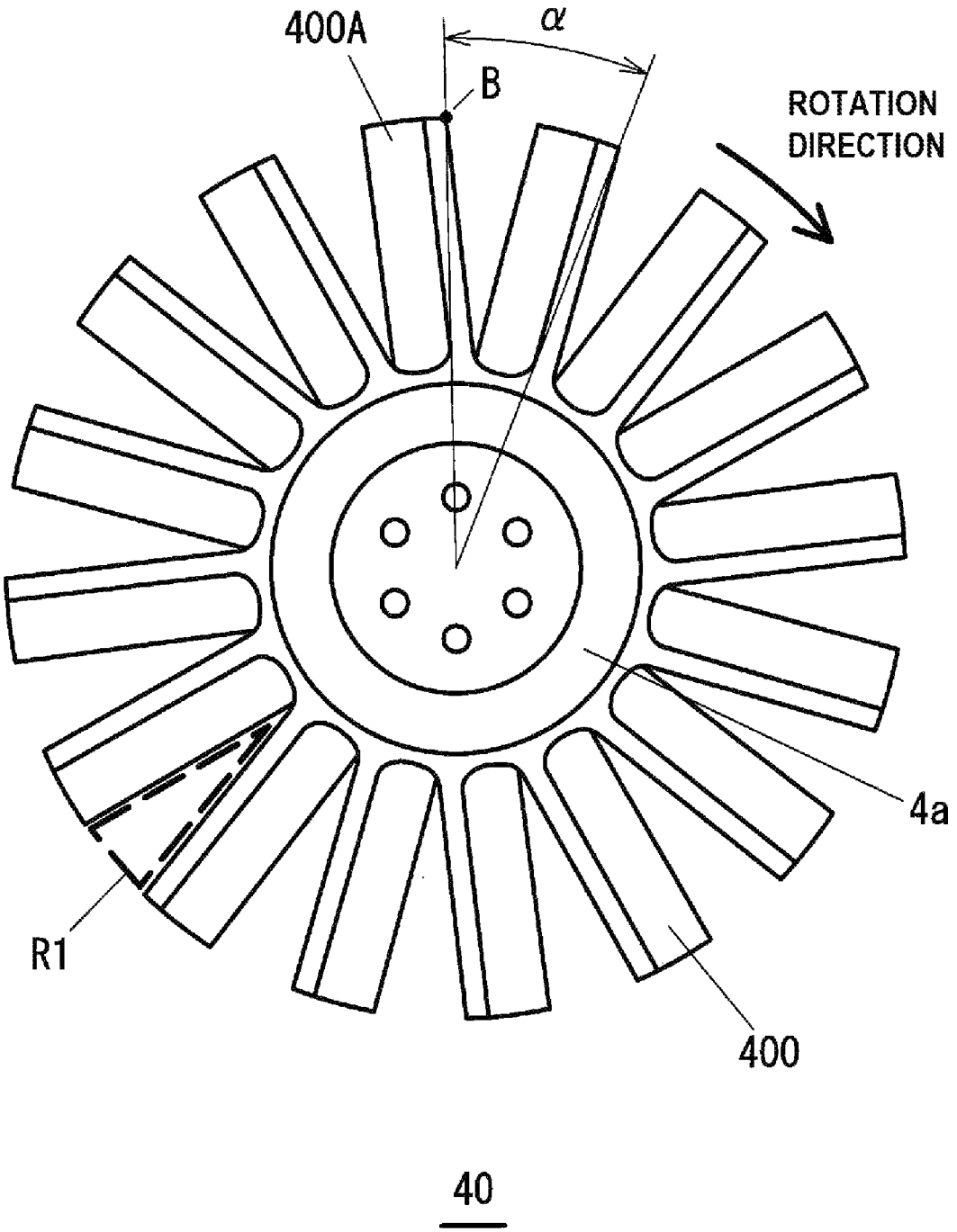
FIG. 2 shows, from a suction side, a view of a first stage of a rotor blade formed at the uppermost stage.

FIG. 2 shows, from a suction side, a view of the first stage of the rotor blade 40 formed at the uppermost stage of the pump rotor 4*a*. Multiple blades 400 are radially formed from the pump rotor 4*a* at the rotor blade 40. Generally, the multiple blades 400 are provided at equal intervals across the entire circumference of 360 degrees, and in an example shown in FIG. 2, are provided at equal intervals at every angle α of 22.5 degrees. Hereinafter, such an angle α will be referred to as an inter-blade angle. That is, the rotor blade 40 shown in FIG. 2 is formed with 16 blades 400 at an inter-blade angle α of 22.5 degrees. A penetration region R1 penetrating a portion between adjacent ones of the blades 400 from a front side to a back side is formed as indicated by a dashed line.

Figure 3:
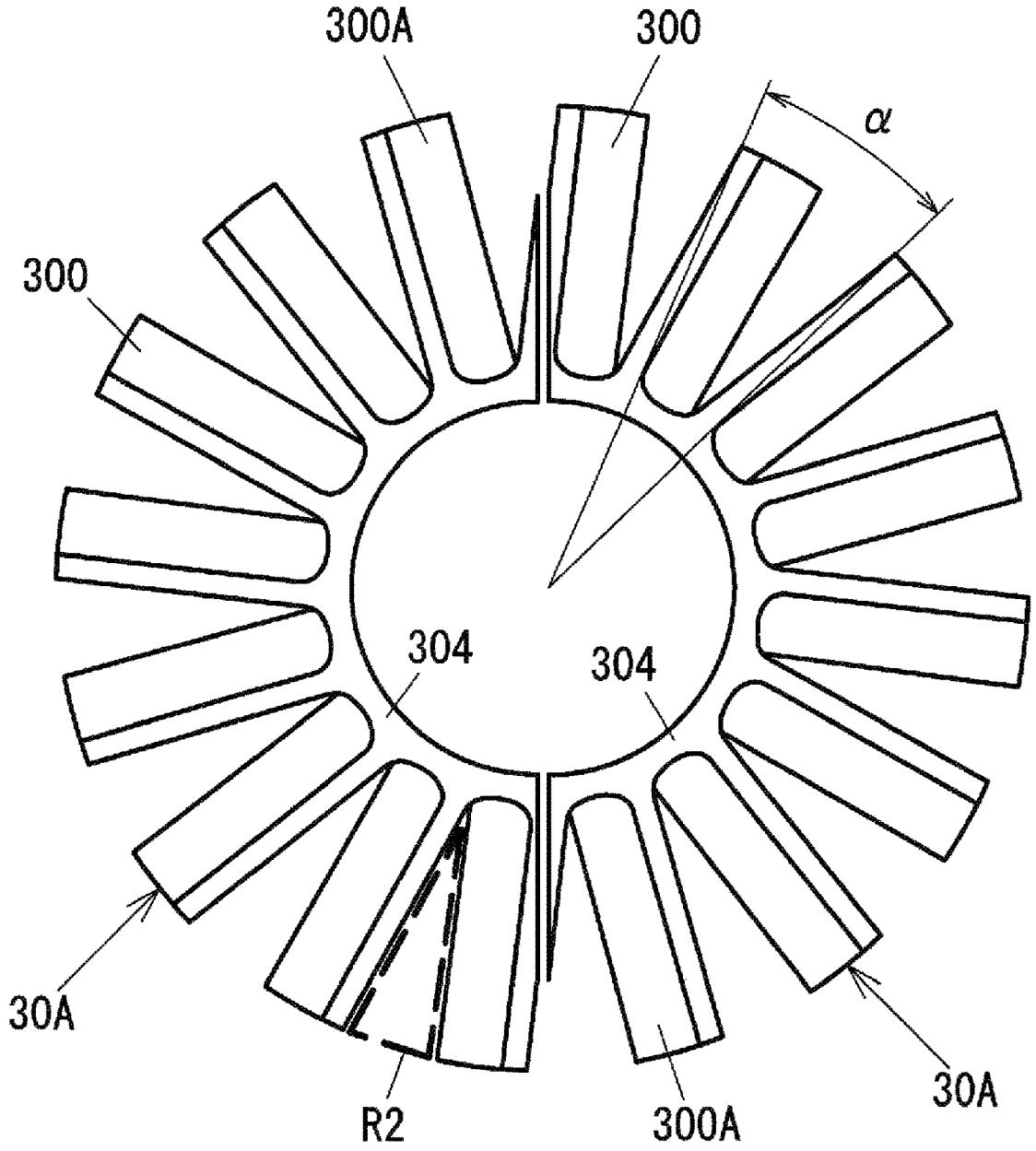
FIG. 3 shows a view of a first stage of a stator blade.

FIG. 3 shows a view of the first stage of the stator blade 30 arranged adjacent to an exhaust downstream side of the rotor blade 40 shown in FIG. 2. The stator blade 30 is divided into two divided stator blades 30A so that these divided stator blades 30A can be arranged between adjacent ones of the stages of the rotor blades 40 in the rotor axis direction. At each divided stator blade 30A, a semi-ring-shaped inner rib portion 304 and multiple blades 300 radially formed on an outer diameter side of the inner rib portion 304 are provided. The multiple blades 300 of the stator blade 30 are formed at the inter-blade angle α (α=22.5 degrees), and the number of blades 300 is 16. A penetration region R2 penetrating a portion between adjacent ones of the blades 300 from a front side to a back side is formed as indicated by a dashed line. Note that in some cases, the penetration regions R1, R2 are not formed depending on settings such as the number of blades and a blade shape.

Figure 4:
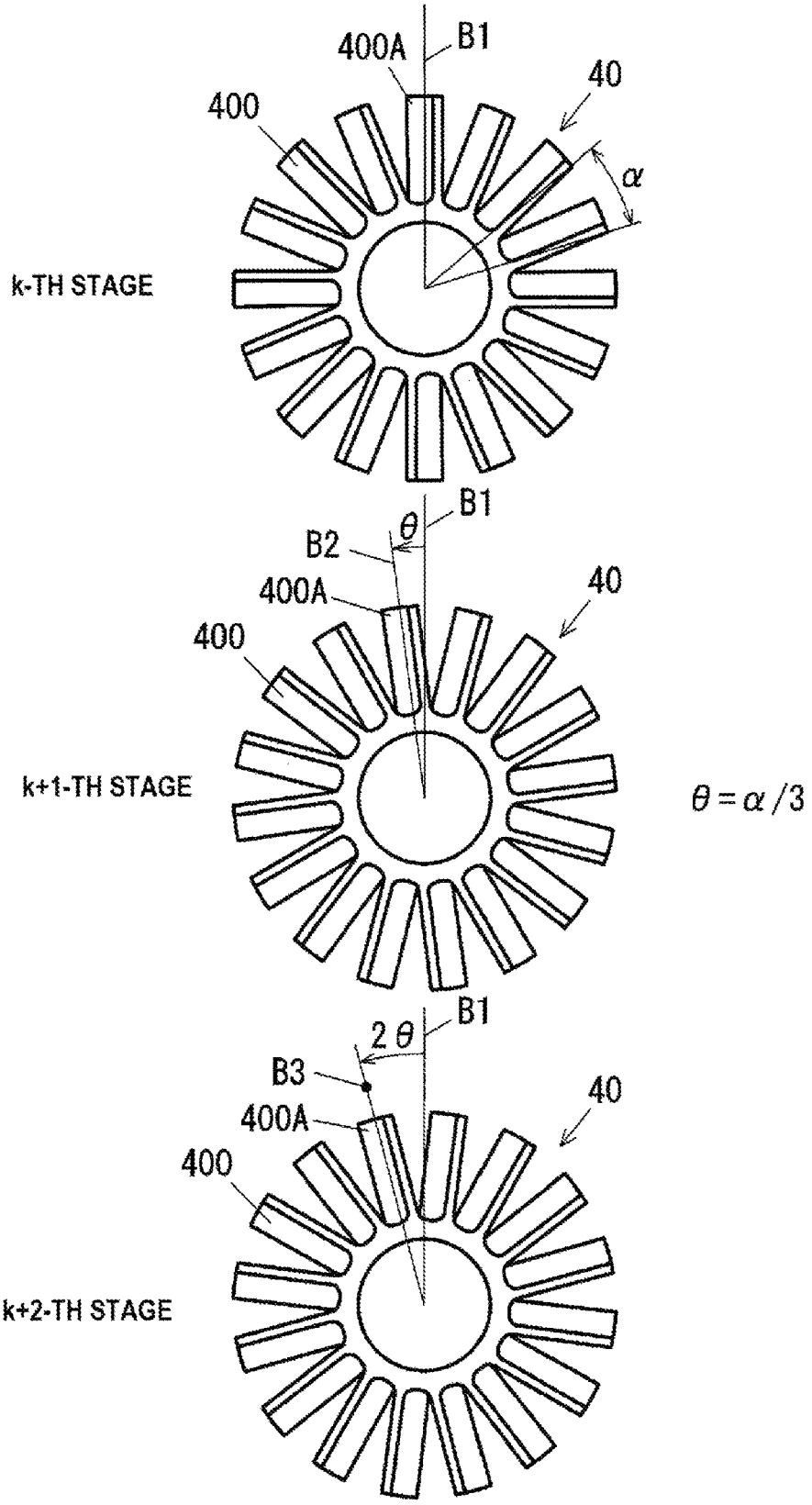
FIG. 4 shows views of k-th, k+1-th, and k+2-th stages of the rotor blades from the suction side.

FIG. 4 shows plan views of the k-th, k+1-th, and k+2-th stages of the rotor blades 40 from the suction side. Note that the shape of the blade 400 of the rotor blade 40 is a shape corresponding to the height (blade height) of the rotor blade in the axial direction, inclination of the blade 400, and the number of blades. Generally, the blade height, the blade inclination, and the number of blades are set for each of the multiple stages of the rotor blades 40, but in an example shown in FIG. 4, the same number of blades and the same shape are employed for the sake of simplicity in description.

Normally, in a case where the multiple stages of the rotor blades 40 are processed and formed into the pump rotor, processing of any of the stages is started from the same position at a circumference of 360 degrees, considering workability in processing. Processing origins of the different stages are coincident with each other as described above, and therefore, in a case where two upper and lower stages of the rotor blades 40 have, for example, exactly the same configuration (with the same number of blades and the same shape), two upper and lower stages of the rotor blades 40 are substantially coincident and overlap with each other as viewed from an exhaust side along the axial direction. In a case where the number of blades is different between two upper and lower stages of the rotor blades 40, the position of the blade 400 to be initially processed is substantially coincident between the upper and lower rotor blades 40. In a case where a blade 400A is a blade to be initially processed in FIG. 2, the position of a point B is, for example, substantially coincident between the upper and lower rotor blades 40.

In the present embodiment, the blade 400 to be initially processed or the blade 400 as a later-described phase shift reference will be referred to as the reference blade 400A, and it is set such that with respect to the reference blade 400A of a particular stage (the first stage on the suction side), the reference blades 400A of other stages are shifted in a circumferential direction. In the example shown in FIG. 4, with respect to the reference blade 400A of the k-th stage, the reference blade 400A of the k+1-th stage is shifted in a counterclockwise direction by an angle θ, and the reference blade 400A of the k+2-th stage is shifted in the counterclockwise direction by an angle 20. The angle θ is set to $0=\alpha/3$ with respect to the angle interval α.

Hereinafter, shift of the reference blades 400A of the other rotor blades 40 from the reference blade 400A of the certain rotor blade 40 in the circumferential direction by, e.g., the angles θ, 2θ will be referred to as phase shift. That is, with respect to the k-th stage of the rotor blade 40, the k+1-th stage of the rotor blade 40 is phase-shifted in the counterclockwise direction by the angle θ, and the k+2-th stage of the rotor blade 40 is phase-shifted in the counterclockwise direction by the angle 20.

Regarding the reference blades 400A of the k-th, k+1-th, and k+2-th stages of the rotor blades 40, the center axes B1, B2, B3 of the reference blades 400A in a width direction thereof may be taken as a reference position of each rotor blade 40 as shown in FIG. 4. The angle of each of the center axes B2, B3 in the width direction with respect to the center axis B1 in the width direction is a phase shift amount of each of the k+1-th and k+2-th stages of the rotor blades 40 with respect to the k-th stage of the rotor blade 40. That is, the reference positions of the k+1-th and k+2-th stages of the rotor blades 40 are phase-shifted from the reference position of the k-th stage of the rotor blade 40 by the angles θ, 2θ.

Figure 5:
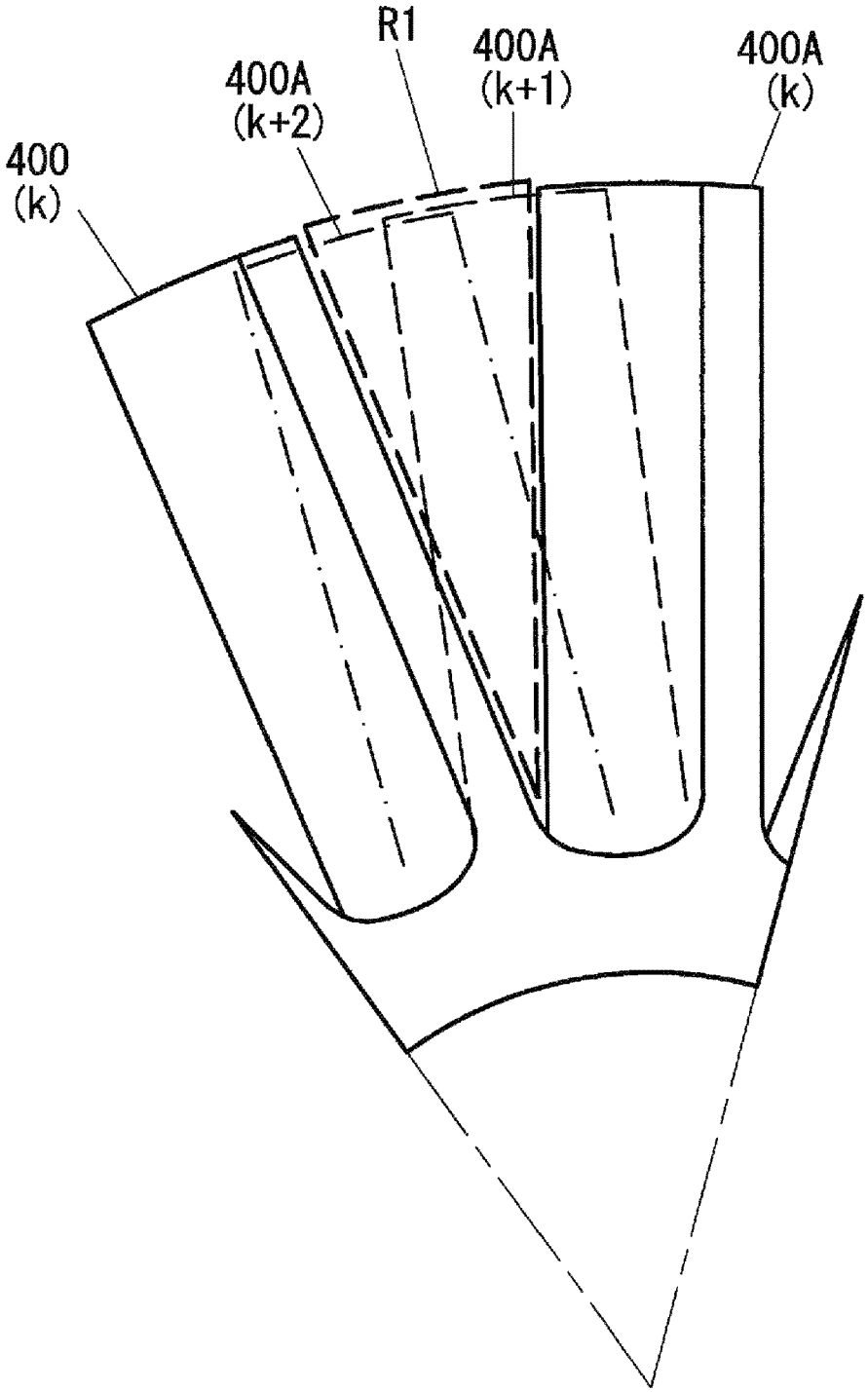
FIG. 5 shows a view for describing a position relationship among the k-th, k+1-th, and k+2-th stages of the rotor blades.

FIG. 5 shows a view of arrangement of the reference blade 400A (indicated by a dashed line) of the k+1-th stage of the rotor blade 40 and the reference blade 400A (indicated by a chain line) of the k+2-th stage of the rotor blade 40 with respect to the reference blade 400A of the k-th stage of the rotor blade 40. The reference blade 400A of the k+1-th stage of the rotor blade 40 phase-shifted from the reference blade 400A of the k-th stage of the rotor blade 40 by the angle θ and the reference blade 400A of the k+2-th stage of the rotor blade 40 phase-shifted from the reference blade 400A of the k-th stage of the rotor blade 40 by the angle 20 are arranged to overlap with the penetration region R1 of the k-th stage of the rotor blade 40. Thus, three stages of the rotor blades 40 from the k-th stage to the k+2-th stage cannot be seen through from the suction side to the exhaust side, and conversely, cannot be seen through from the exhaust side to the suction side.

(Principle of Discharging at Turbo Pump Stage)

Figure 6:
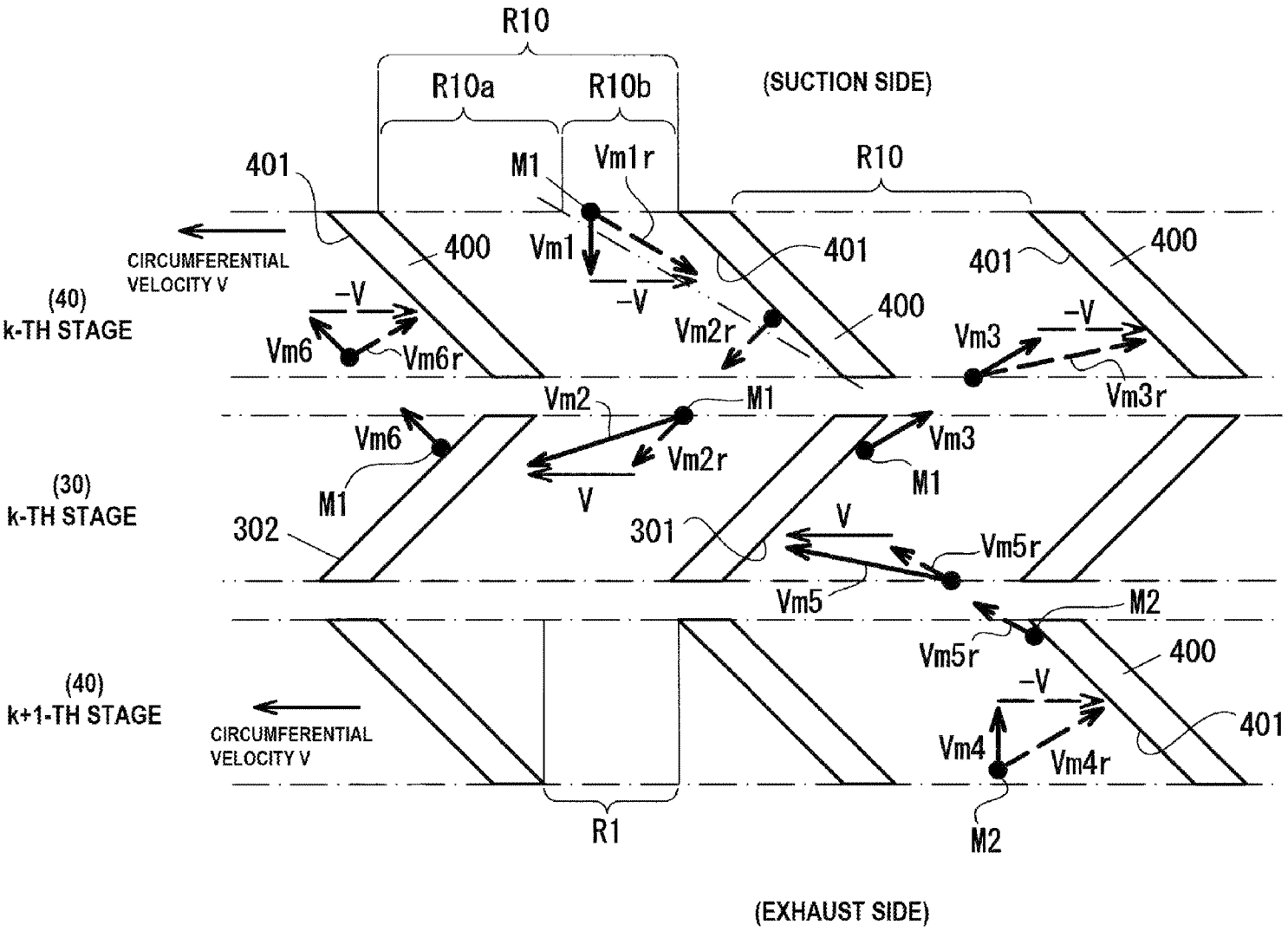
FIG. 6 shows a view for describing the principle of discharging at a turbo pump stage.

FIG. 6 shows a view for describing the principle of discharging at the turbo pump stage, and shows a sectional view of part of the turbo-molecular pump stage in the circumferential direction. Note that FIG. 6 shows the turbo-molecular pump stage with a configuration similar to that of a general turbo-molecular pump, and the same position is employed as the processing origin of the rotor blade 40. From the top as viewed in the figure, the k-th stage of the rotor blade 40, the k-th stage of the stator blade 30, and the k+1-th stage of the rotor blade 40 are shown. The processing origins of the k-th and k+1-th stages of the rotor blades 40 are the same position, and therefore, the penetration regions R1 thereof face each other through the stator blade 30. The rotor blades 40 rotate relative to the stator blade 30, and therefore, the blades 400 of the rotor blades 40 move in the leftward direction as viewed in the figure at a circumferential velocity V relative to the blades 300 of the stator blade 30 in FIG. 6.

(1) Gas Molecule Entering from Suction Side

A case where a gas molecule M1 enters the rotor blade 40 from the suction side in the downward direction as viewed in the figure at a velocity Vm1 is assumed herein. Note that a region between adjacent ones of the blades 400 will be referred to as a clearance region R10. The blade 400 of the rotor blade 40 moves in the leftward direction as viewed in the figure at the circumferential velocity V, and therefore, the relative velocity Vm1*r* of the gas molecule M1 as viewed from the blade 400 is a synthesized velocity of the velocity Vm1 and a velocity −V in a lower right direction. Of the gas molecules M1 at the velocity Vm1, those having entered a clearance region R10*a* as part of the clearance region R10 pass through the k-th stage of the rotor blade 40 to travel through a portion between the blades 400 inclined in the lower right direction, and enter the k-th stage of the stator blade 30. Meanwhile, the gas molecules M1 having entered a clearance region R10*b* as the remaining part of the clearance region R10 at the relative velocity Vm1*r* collide with a back surface 401 of the blade 400.

The gas molecule M1 having entered toward the back surface 401 of the blade 400 at the relative velocity Vm1*r* is reflected on the back surface 401, and is emitted from the back surface 401. Such an emission direction is not always a specular reflection direction, and it is assumed that in other directions, the gas molecule M1 is also present with a probability depending on an emission angle (an angle from a normal line). The back surface 401 of the blade 400 is inclined to face the exhaust side, and therefore, there is a high probability that the gas molecule M1 having entered toward such a back surface 401 is emitted to the exhaust side. A case where the gas molecule M1 is emitted in a normal direction of the back surface 401 at a relative velocity Vm2*r* is assumed herein. The gas molecule M1 emitted at the relative velocity Vm2*r* from the blade 400 moving at the circumferential velocity V enters the k-th stage of the stopped stator blade 30 at a velocity Vm2. The velocity Vm2 is a synthesized velocity of the relative velocity Vm2*r* and a velocity V, and the gas molecule M1 moves in a lower left direction at a shallow angle with respect to the horizontal direction as shown in FIG. 6.

The blade 300 is inclined diagonally in the lower left direction opposite to that of the blade 400, and therefore, most of the gas molecules M1 having entered the stator blade 30 from the rotor blade 40 pass through the stator blade 30 to travel through a portion between the blades 300, or collide with a back surface 301 of the blade 300. The back surface 301 of the blade 300 is inclined to face the exhaust side, and therefore, there is a high probability that the gas molecule M1 having entered toward the back surface 301 is reflected on the back surface 301 and is emitted in the direction of the k+1-th stage of the rotor blade 40. Then, the gas molecule M1 having entered the k+1-th stage of the rotor blade 40 from the k-th stage of the stator blade 30 moves from the k+1-th stage of the rotor blade 40 to the exhaust side through a process similar to that in the case of the gas molecule M1 having entered the k-th stage of the rotor blade 40 from the suction side.

Of the gas molecules M1 having entered toward the back surface 301 of the blade 300, the gas molecules M1 emitted at a velocity Vm3 to flow back from the back surface 301 and entering the k-th stage of the rotor blade 40 have, as a relative velocity Vm3*r* as viewed from the blade 400, a synthesized speed of the emission velocity Vm3 and the velocity −V. Thus, most of these gas molecules M1 enter toward the back surface 401 of the blade 400.

Meanwhile, some of the gas molecules M1 having travelled through the portion between the blades 400 of the k-th stage of the rotor blade 40 and entered the k-th stage of the stator blade 30 travel through the portion between the blades 300, and the remaining gas molecules M1 enter toward an upper surface 302 of the blade 300. The upper surface 302 of the blade 300 faces the suction side, and therefore, some of the gas molecules M1 having entered toward the upper surface 302, such as the gas molecules M1 reflected on the upper surface 302 and emitted from the upper surface 302 at a velocity Vm6, enter the k-th stage of the rotor blade 40 again.

The relative velocity Vm6*r* of the gas molecule M1 as viewed from the blade 400 moving at the circumferential velocity V is a synthesized velocity of the velocity Vm6 and the velocity −V. Thus, the gas molecule M1 enters toward the back surface 401 of the blade 400. Thereafter, the gas molecule M1 is reflected on the back surface 401 of the blade 400, and is emitted from the back surface 401. As in the case of the gas molecule M1 emitted at the relative velocity Vm2*r* as described above, the gas molecule M1 enters the k-th stage of the stator blade 30. As described above, the rotor blades 40 rotate relative to the stator blade 30 at the circumferential velocity V, and accordingly, most of the gas molecules M1 having entered from the suction side are transferred to the exhaust side.

(2) Backflow Molecule Entering from Exhaust Side

Next, a gas molecule entering the k+1-th stage of the rotor blade 40 from the exhaust side, i.e., a backflow molecule, will be described. A case where a gas molecule M2 enters in the upward direction as viewed in the figure at a velocity Vm4 as in a gas molecule M2 shown in FIG. 6 is assumed herein. The blade 400 of the k+1-th stage of the rotor blade 40 moves in the leftward direction as viewed in the figure at the circumferential velocity V, and therefore, the relative velocity Vm4*r* of the gas molecule M2 as viewed from the blade 400 is a synthesized velocity of the velocity Vm4 and the velocity −V in an upper right direction. Thus, most of the gas molecules M2 collide with the back surface 401 of the blade 400, and a probability that the gas molecule M2 travels through a portion between the blades 400 in a suction side direction is low.

As described above, the gas molecule M2 having entered toward the back surface 401 of the blade 400 has a probability that such a gas molecule M2 is reflected not only in the specular reflection direction but also in other directions. For example, in some cases, the gas molecule M2 is emitted from the back surface 401 of the blade 400 at a relative velocity Vm5*r*, and enters the k-th stage of the stator blade 30 provided on the suction side. In this case, the blade 400 moves in the leftward direction at the circumferential velocity V relative to the blade 300 of the k-th stage of the stator blade 30, and therefore, the velocity Vm5 of the gas molecule M2, which is emitted from the blade 400 at the relative velocity Vm5*r*, relative to the blade 300 is a synthesized velocity of the relative velocity Vm5*r* and the circumferential velocity V. As described above, most of the gas molecules M2 having flowed back and collided with the blade 400 of the k+1-th stage of the rotor blade 40 move diagonally in the leftward direction as indicated by the velocity Vm5, and collide with the back surface 301 of the blade 300 of the k-th stage of the stator blade 30.

As in the case of the gas molecule M1 having entered toward the back surface 401 of the blade 400 of the k-th stage of the rotor blade 40 as described above, most of the gas molecules M2 having entered toward the back surface 301 of the blade 300 of the k-th stage of the stator blade 30 are reflected in the direction of the k+1-th stage of the rotor blade 40 on the exhaust side, and a few of these gas molecules M2 pass through the k-th stage of the stator blade 30 toward the suction side, and enter the k-th stage of the rotor blade 40. As described above, most of the gas molecules (the backflow molecules) having entered the k-th stage of the rotor blade 40 from the exhaust side are discharged to the exhaust side, and as a total, the gas molecules are discharged from the suction side to the exhaust side.

Under high-flow-rate and high-back-pressure conditions (sometimes referred to as intermediate/continuous flow conditions), transition to a state in which intermolecular collision often occurs is being made while the gas molecules are passing through the turbo pump stage. Needless to say, even under these conditions, most of the backflow molecules from the exhaust side to the suction side collide, based on the above-described principle of discharging, with and bounced on the blades of the blade stages arranged in the pump axial direction, and are transferred to the exhaust side.

However, a backflow through adjacent stages under the high-flow-rate and high-back-pressure conditions is caused due to a density flow from a high-density portion to a low-density portion, and is represented by a velocity vector from a high-pressure side (the exhaust side) to a low-pressure side (the suction side). Thus, in the case of the configuration in which the k-th and k+1-th stages of the rotor blades 40 stopped relative to each other can be seen through the penetration regions R1 from the exhaust side to the suction side as shown in FIG. 6, influence of the backflow can be unignorable.

As described above, in the present embodiment, the reference positions (the positions indicated by the center axes B1 to B3 in the width direction) of the k-th, k+1-th, and k+2-th stages of the rotor blades 40 are phase-shifted as in FIG. 4. With this configuration, three stages of the rotor blades 40 from the k-th stage to the k+2-th stage cannot be seen through from the exhaust side to the suction side as shown in FIG. 5, and the influence of the backflow can be reduced.

In a case where there are nine stages of the rotor blades 40 as shown in FIG. 1, the phase shift amount with respect to the reference position of the first stage of the rotor blade 40 is, for processing, preferably set in a cyclic manner such as θ/3, 2θ/3, 0, θ/3, 2θ/3, 0, θ/3, and 2θ/3 in this order from the second stage to the ninth stage. Needless to say, even if such an amount is not set in the cyclic manner, a backflow reduction effect is similarly provided. Instead of such a phase shift that all of the nine stages are shifted from each other, the phase shift may be applied to any three to eight stages of the nine stages. In this case, the phase shift is preferably applied to the exhaust-side stages with a greater pressure range.

Note that in the example shown in FIGS. 4 and 5, the case where the angle θ is set to ⅓ of the inter-blade angle α between the blades 400 and the k+1-th and k+2-th stages of the rotor blades 40 are phase-shifted from the k-th stage of the rotor blade 40 by θ (=α/3) and 20 has been described, but the configuration for the phase shift is not limited to above. In a more general expression, when m is a positive real number equal to or less than the total number of stages of the rotor blades 40 and greater than one, the multiple stages of the rotor blades 40 can be expressed as those including the non-phase-shifted rotor blade 40 at the inter-blade angle α and the rotor blade of which reference position is phase-shifted from the reference position of the non-phase-shifted rotor blade 40 at the inter-blade angle α by an angle α·K/m (note that K is a natural number which is not the multiple of m in a case where m is a natural number, and is a natural number in a case where m is not a natural number).

FIGS. 4 and 5 show the case of m=3, and K is selected from natural numbers not including the multiples of 3, such as 1, 2, 4, 5, 7, . . . . In the case of m=2, K is selected from natural numbers not including the multiples of 2, such as 1, 3, 5, 7, . . . . In the case of m=4, K is selected from natural numbers not including the multiples of 4, such as 1, 2, 3, 5, 6, 7, 9, . . . .

In the case of m=3, the phase shift may be, including two types of rotor blades 40 which are the k-th stage and the k+1-th or k+2-th stage, applied to all or some of the multiple stages of the rotor blades 40. Alternatively the phase shift may be, including three types of rotor blades 40 which are the k-th, k+1-th, and k+2-th stages, applied to all or some of the multiple stages of the rotor blades 40. For example, when the case of m=3 is, as one example, applied to the first to fifth stages on the suction side, the first stage is taken as the rotor blade 40 at the inter-blade angle α, and the second to fifth stages of the rotor blades 40 are phase-shifted by α/3, 2(α/3), 3(α/3), and 4(α/3) in this order. Needless to say, the angles α/3, 2(α/3), 3(α/3), and 4(α/3) may be applied to the second to fifth stages of the rotor blades 40 in a changed order. As a result, the first to fifth stages of the rotor blades 40 include the rotor blade 40 at the inter-blade angle α and two types (=m−1) of rotor blades 40 phase-shifted by the angles α/3, 2(α/3). Alternatively, the first to fifth stages of the rotor blades 40 may include only the non-phase-shifted rotor blade 40 at the inter-blade angle α and the rotor blade 40 phase-shifted by the angle α/3.

In a case where m is the real number greater than one and is not the natural number, such as the case of m=2.5, the angle of the phase shift is also set to α·K/m. Note that in a case where m is not the natural number, K is selected from natural numbers of 1, 2, 3, 4, 5, . . . , (the total number−1). For example, the case of m=2.5 is, as one example, applied to the first to fifth stages on the suction side, the first stage is taken as the rotor blade 40 at the inter-blade angle α, and the second to fifth stages of the rotor blades 40 are phase-shifted by α/2.5, 2(α/2.5), 3(α/2.5), and 4(α/2.5). Needless to say, the angles α/2.5, 2(α/2.5), 3(α/2.5), and 4(α/2.5) may be applied to the second to fifth stages of the rotor blades 40 in a changed order. Alternatively, the first to fifth stages of the rotor blades 40 may include only the non-phase-shifted rotor blade 40 at the inter-blade angle α and some (e.g., the rotor blade 40 at the angle α/2.5) of the phase-shifted rotor blades 40.

Alternatively, all stages of the rotor blades 40 may include the non-phase-shifted rotor blade 40 at the inter-blade angle α and the phase-shifted rotor blade 40. For example, the one-end-side stage of the multiple stages of the rotor blades 40 is taken as the non-phase-shifted rotor blade 40 at the inter-blade angle α, and the phase shift is sequentially made by an angle α/m, such as α/m, 2(α/m), 3(α/m), . . . . For example, in the case of the natural number as in m=3, the rotor blades 40 are, for the sake of easy processing, preferably arranged such that, e.g., a phase shift of 0, α/3, 2(α/3), 0, α/3, 2(α/3), 0, . . . is made in this order from the first stage in a cyclic manner.

In a case where m is not the natural number, the phase shift is not made in the cyclic manner, except for a case where the multiples of m are included in K as in m=2.5, for example. Thus, not only in a case where m is the natural number but also in a case where m is not the natural number, the first stage of the rotor blade 40 and the k-th stage of the rotor blade 40 that (k−1) is the multiple of m are set as the non-phase-shifted rotor blades 40 at the inter-blade angle α, and the k-th stage of the rotor blade 40 that (k−1) is not the multiple of m is set as the rotor blade 40 phase-shifted by an angle α·(k−1)/m. Such a setting may be applied to all stages of the rotor blades 40, or may be applied to some stages of the rotor blades 40.

Even in a case where m is not the natural number, such as the case of m=2.5, the rotor blades 40 may be configured such that a phase shift of 0, α/2.5, 2(α/2.5), 0, α/2.5, 2(α/2.5), 0, . . . is made in this order from the first stage in a cyclic manner. Needless to say, the rotor blades 40 phase-shifted by 0, α/2.5, and 2(α/2.5) may be arranged in a random order. In this case, the multiple stages of the rotor blades can be expressed as those including the rotor blade at an inter-blade angle α1 and |m| types of rotor blades of which reference positions are phase-shifted from the reference position of the non-phase-shifted rotor blade at the inter-blade angle α1 by the angle α·K/m (note that K is a natural number less than m).

Note that in the example shown in FIGS. 4 and 5, it has been described that the same number of blades is employed among the k-th to k+2-th stages of the rotor blades 40. However, even in a case where the multiple stages of the rotor blades 40 include those having different numbers of blades, the reference position of the rotor blade 40 (the position of the reference blade 400A) is phase-shifted as described above so that the backflow reduction effect can be obtained. Generally, the number of blades is set to an even number. In this case, even in a case where the multiple stages of the rotor blades 40 include those having different numbers of blades, if the position of the reference blade 400A is coincident among the stages, the rotor blades 40 can be seen through from the exhaust side to the suction side at least in the vicinity of the reference blade 400A and the vicinity of a location of which phase is shifted from the reference blade 400A by 180 degrees. Thus, the positions of the reference blades 400A of the multiple stages of the rotor blades 40 are phase-shifted so that the backflow reduction effect can be obtained.

In description above, the phase shift is applied to the rotor blades 40 stopped relative to each other, but the phase shift similar to that in the case of the rotor blades 40 as described above can be also applied to the stator blades 30 stopped relative to each other. That is, when n is a positive real number equal to or less than the total number of stages of the stator blades 30 and greater than one, the multiple stages of the stator blades 30 include the stator blade 30 at an inter-blade angle $\alpha 2$ and the stator blade 30 of which reference position is phase-shifted from the reference position of the non-phase-shifted stator blade 30 at the inter-blade angle $\alpha 2$ by an angle $\alpha 2 \cdot /Ln$ (note that L is a natural number which is not the multiple of n). Not only in the case of n=3 but also a case where n is a positive real number equal to or less than the total number of stages of the stator blades 30 and greater than one, if the phase shift is applied to all or some of the multiple stages of the stator blades 30, the phase shift can be, similarly to the case of the multiple stages of the rotor blades 40, applied to, e.g., a case where the phase shift is sequentially made in a cyclic or non-cyclic manner by the constant angle $\theta$.

Generally, the stator blade 30 includes the pair of divided stator blades 30A as shown in FIG. 3. For example, as shown in FIG. 3, the blade 300 arranged on one end side among the multiple fan-shaped blades 300 is set as a reference blade 300A of the stator blade 30 corresponding to the reference blade 400A of the rotor blade 40 as described above. That is, a pair of reference blades 300A is set for the stator blade 30 at an interval of 180 degrees. Alternatively, a boundary between the divided stator blades 30A in a pair may be set as the reference position.

Upon assembly of the multiple stages of the stator blades 30, the pair of divided stator blades 30A is phase-shifted and arranged on the spacer ring 33 such that the positions of the reference blades 300A of the stator blades 30 or the boundaries (i.e., the reference positions) between the divided stator blades 30A in a pair are shifted from each other, such as the boundary positions are sequentially phase-shifted by the angle $\theta$. As a result, as in the case of the rotor blade 40, the blades 300 of other stages of the stator blades 30 overlap with the penetration region R2 of the stator blade 30 so that the influence of the backflow can be reduced.

Figure 7:
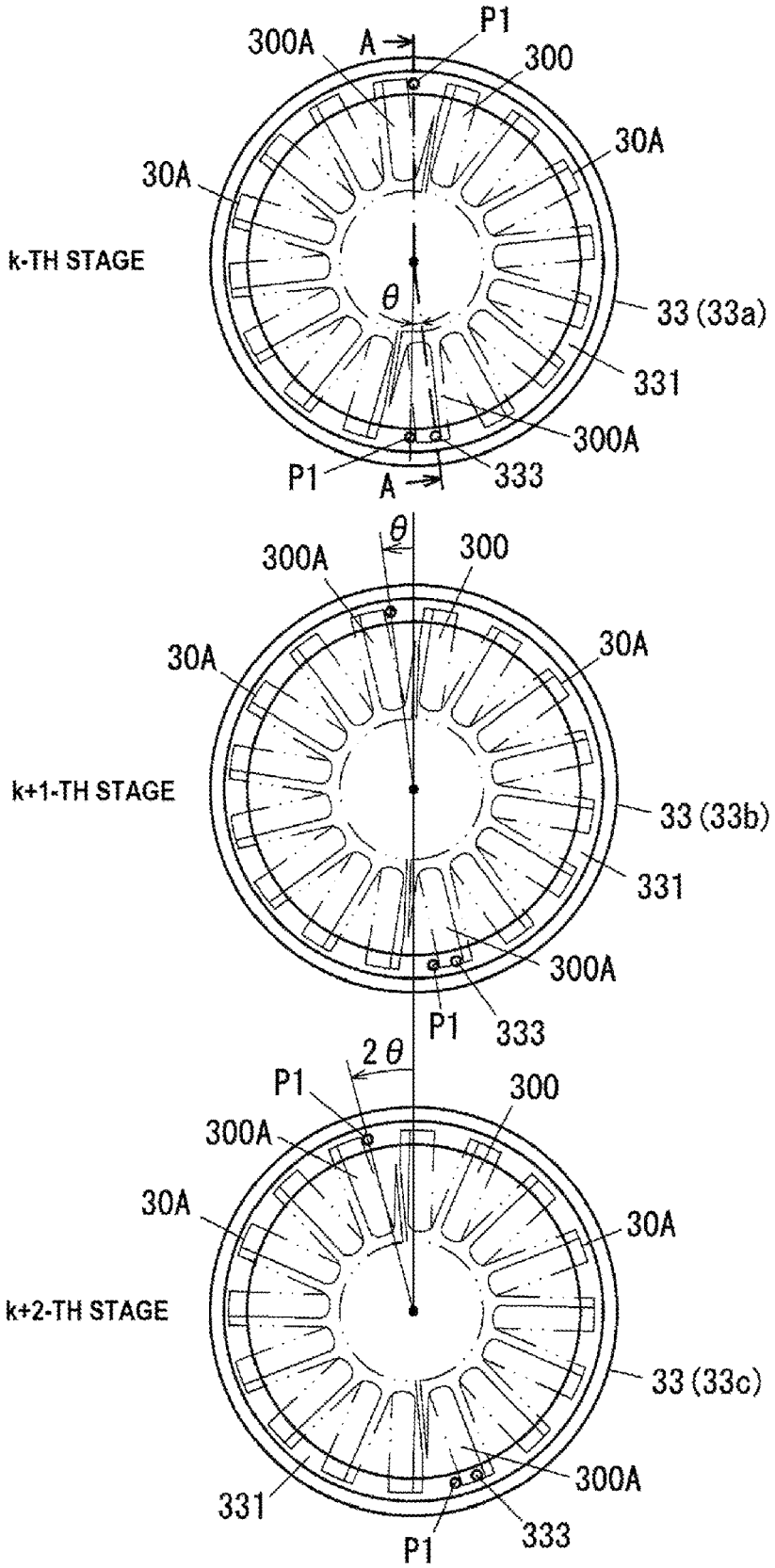
FIG. 7 shows plan views of three stages of spacer rings from the suction side.
Figure 8:
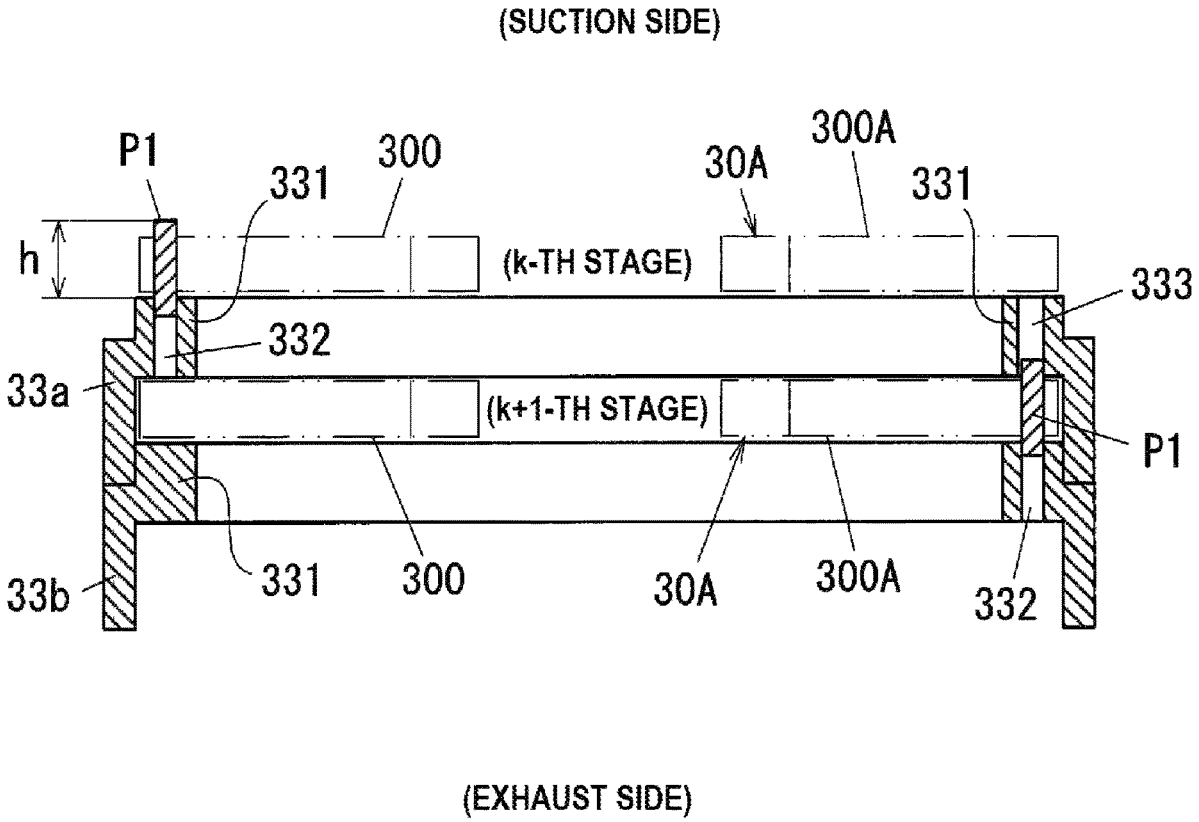
FIG. 8 shows a sectional view of two stages of the spacer rings along an A-A line.

FIGS. 7 and 8 show views of one example of a position adjustment mechanism in a case where the reference positions of the multiple stages of the stator blades 30 are sequentially phase-shifted by the constant angle $\theta$. FIG. 7 shows, from the suction side, plan views of three spacer rings 33 (33*a*, 33*b*, 33*c*) on which the k-th, k+1-th, and k+2-th stages of the stator blades 30 (the pair of divided stator blades 30A) are placed. That is, n as described above is set to n=3, and the stator blades 30 include the non-phase-shifted k-th stage of the stator blade and the k+1-th (the case of L=1) and k+2-th (the case of L=2) stages of the stator blades of which reference positions are phase-shifted from the reference position of the k-th stage of the stator blade by an angle $\alpha \cdot L/n$ (note that L is a natural number which is not the multiple of n). FIG. 8 shows a view of a section along an A-A line of FIG. 7, and shows the k-th and k+1-th stages of the stator blades 30 and the spacer rings 33 alternately stacked on each other. Note that for reference, FIGS. 8 and 9 show the stator blades 30 by chain double-dashed lines.

At each of the spacer rings 33*a*, 33*b*, 33*c* shown in FIG. 7, pins P1 for adjusting the position of the pair of divided stator blades 30A on the spacer ring 33 and a through-hole 333 are provided. In this case, the position of the pin P1 corresponds to the reference position of the stator blade 30. Two pins P1 are provided at an interval of 180 degrees. The position of the through-hole 333 is phase-shifted in the counterclockwise direction from the pin P1 by the angle $\theta$. As shown in FIG. 8, the pin P1 is provided to protrude upward of a hole 332 formed at a blade placement portion 331 of the spacer ring 33. The amount h of protrusion of the pin P1 is set greater than the blade height of the divided stator blade 30A, and the pin P1 enters the through-hole 333 of the spacer ring 33 arranged above.

In a case where the pair of divided stator blades 30A of the k+1-th stage is placed on the spacer ring 33*b*, the divided stator blades 30A are each placed on both right and left sides of the pair of pins P1 as shown in FIG. 7. As described above, the phases of the reference positions of the pair of divided stator blades 30A are set by the pins P1. Next, the spacer ring 33*a* is placed on the pair of divided stator blades 30A of the k+1-th stage. At this point, as shown in FIG. 8, the spacer ring 33*a* is placed such that the pin P1 of the spacer ring 33*b* of the lower stage is inserted into the through-hole 333 of the spacer ring 33*a*. Subsequently, the divided stator blades 30A are each placed on the blade placement portion 331 on both right and left sides of the pins P1 of the spacer ring 33*a*.

As a result, the k+1-th stage of the stator blade 30 (the pair of divided stator blades 30A) is phase-shifted in the counterclockwise direction from the k-th stage of the stator blade 30 by the angle $\theta$. With such a position adjustment mechanism (two pins P1 and the through-hole 333), workability in assembly can be improved, and an assembly error can be prevented.

FIGS. 7 and 8 show the case of n=3. For example, in the case of n=4, the stator blades 30 include the non-phase-shifted stator blade 30 and three types of stator blades 30 of which phase shift angles are $\alpha/n$ in the case of L=1, $2(\alpha/n)$ in the case of L=2, and $3(\alpha/n)$ in the case of L=3.

Note that the phase shift of the reference position as described above may be applied only to one of the rotor blade 40 or the stator blade 30, or may be applied to both of the rotor blade 40 and the stator blade 30. In the case of any of the rotor blade 40 and the stator blade 30, the stage closest to the suction side has been described as the first stage, but even a case where the stage closest to the exhaust side is taken as the first stage works similarly to description above.

Example

FIGS. 9 and 10 show simulation results in a case where the rotor blade and the stator blade of the present invention were applied to an existing turbo-molecular pump. FIG. 9 shows the rate of improvement of exhaust performance (an exhaust velocity) in a case where the phase shift of the present invention was applied to a rotor blade and a stator blade of an existing 4000-L/s-class turbo-molecular pump. The first to third rows indicate a ½ pitch shift case where the phase shift is made in a cyclic manner by ½ of the inter-blade angle $\alpha$, and the fourth to sixth rows indicate a ⅓ pitch shift case where the phase shift is made in a cyclic manner by ⅓ of the inter-blade angle $\alpha$. For any of the ½ pitch shift and the ⅓ pitch shift, a case where only the rotor blade is phase-shifted, a case where only the stator blade is phase-shifted, and a case where both of the rotor blade and the stator blade are phase-shifted were shown. In any case, the influence of the backflow is reduced, and the performance is improved. However, the ⅓ pitch shift is more effective than the ½ pitch shift in many cases. Moreover, tendency shows that the rate of improvement of the performance is higher in the rotor blade than in the stator blade.

FIG. 10 shows the rate of improvement of the performance in a case where the phase shift is applied to an existing 2000-L/s to 7000-L/s-class turbo-molecular pump. FIG. 10 shows a case where the ⅓ pitch shift was applied only to the rotor blade and a case where the ⅓ pitch shift was applied to both of the rotor blade and the stator blade, advantageous effects thereof being noticeable in FIG. 9. It can be considered that the phase shift of the present invention is employed so that an exhaust performance improvement effect of equal to or higher than 10% can be expected in almost all models.

Those skilled in the art understand that the above-described exemplary embodiment and example are specific examples of the following aspects.

[1] A turbo-molecular pump according to one aspect includes multiple stages of rotor blades formed with multiple blades and provided in a rotor axis direction and multiple stages of stator blades formed with multiple blades, the multiple stages of the stator blades and the multiple stages of the rotor blades being alternately arranged in the rotor axis direction. When m is a positive real number equal to or less than the total number of stages of the rotor blades and greater than one and K is a natural number which is not the multiple of m in a case where m is a natural number and is a natural number in a case where m is not the natural number, the multiple stages of the rotor blades include a rotor blade at an inter-blade angle $\alpha 1$ and a rotor blade of which reference position is phase-shifted from a reference position of the rotor blade at the inter-blade angle $\alpha 1$ by an angle $\alpha 1 \cdot K/m$.

The rotor blade of which reference position is phase-shifted by an angle $\alpha 1 \cdot K/m$ (note that K is a natural number which is not the multiple of m) is included. Thus, as shown in, e.g., FIG. 5, arrangement is made such that the blades 400*b*, 400*c* of the phase-shifted rotor blades 40 overlap with the penetration region R1 formed between adjacent ones of the blades 400*a*. As a result, the rotor blades 40 cannot be seen through from the suction side to the exhaust side, and therefore, the influence of the backflow can be reduced and the exhaust performance can be improved.

[2] In the turbo-molecular pump according to [1], when n is a positive real number equal to or less than the total number of stages of the stator blades and greater than one and L is a natural number which is not the multiple of n in a case where n is a natural number and is a natural number in a case where n is not the natural number, the multiple stages of the stator blades include a stator blade at an inter-blade angle $\alpha 2$ and a stator blade of which reference position is phase-shifted from a reference position of the stator blade at the inter-blade angle $\alpha 2$ by an angle $\alpha 2 \cdot L/n$.

The multiple stages of the stator blades are configured as described above, and therefore, the influence of the backflow is reduced as in the case of the phase shift of the rotor blade as described above. Thus, the phase shift is made for both of the rotor blade and the stator blade so that the exhaust performance can be further improved.

[3] A turbo-molecular pump according to one aspect includes multiple stages of rotor blades formed with multiple blades and provided in a rotor axis direction and multiple stages of stator blades formed with multiple blades, the multiple stages of the stator blades and the multiple stages of the rotor blades being alternately arranged in the rotor axis direction. When n is a positive real number equal to or less than the total number of stages of the stator blades and greater than one and L is a natural number which is not the multiple of n in a case where n is a natural number and is a natural number in a case where n is not the natural number, the multiple stages of the stator blades include a stator blade at an inter-blade angle $\alpha 2$ and a stator blade of which reference position is phase-shifted from a reference position of the stator blade at the inter-blade angle $\alpha 2$ by an angle $\alpha 2 \cdot L/n$.

Even in a case where only the stator blade is phase-shifted, the phase-shifted stator blade is included so that the influence of the back flow can be reduced and the exhaust performance can be improved as in the case of phase-shifting only the rotor blade as described above.

[4] In the turbo-molecular pump according to [1] or [2], when the total number of stages of the rotor blades is M, a one-end-side stage of the multiple stages of the rotor blades is taken as a first stage of the rotor blade, and an other-end-side stage of the rotor blade is taken as an M-th stage of the rotor blade, the first stage of the rotor blade and a k1-th stage of the rotor blade that (k1−1) is the multiple of m are set as the rotor blade at the inter-blade angle $\alpha 1$, and a k1-th stage of the rotor blade that (k1−1) is not the multiple of m is set as a rotor blade phase-shifted by an angle $\alpha 1 \cdot (k1-1)/m$. Therefore, the influence of the backflow can be efficiently reduced by configuring the rotor blades of each stage as described above.

[5] In the turbo-molecular pump according to any one of [2] to [4], when the total number of stages of the stator blades is N, a one-end-side stage of the multiple stages of the stator blades is taken as a first stage of the stator blade, and an other-end-side stage of the stator blade is taken as an N-th stage of the stator blade, the first stage of the stator blade and a k2-th stage of the stator blade that (k2−1) is the multiple of n are set as the stator blade at the inter-blade angle $\alpha 2$, and a k2-th stage of the stator blade that (k2−1) is not the multiple of n is set as a stator blade phase-shifted by an angle $\alpha 2 \cdot (k2-1)/n$. Therefore, the influence of the backflow can be efficiently reduced by configuring the stator blades of each stage as described above as in the case of the rotor blade.

[6] The turbo-molecular pump according to any one of [2] to [5] further includes multiple spacer rings provided such that the spacer rings and the multiple stages of the stator blades are alternately stacked on each other in the pump axis direction. Each spacer ring has a position adjustment member configured to adjust the reference position of each stator blade.

As shown in FIG. 7, the phases of the assembly reference positions of the pair of divided stator blades 30A are set by the pins P1 in such a manner that the divided stator blades 30A are each placed on both right and left sides of the pair of pins P1. Next, the spacer ring 33*a* is placed on the pair of divided stator blades 30A of the k+1-th stage. At this point, as shown in FIG. 8, the spacer ring 33*a* is placed such that the pin P1 of the spacer ring 33*b* of the lower stage is inserted into the through-hole 333 of the spacer ring 33*a*. Subsequently, the divided stator blades 30A are each placed on the blade placement portion 331 on both right and left sides of the pins P1 of the spacer ring 33*a*. As a result, the k-th and k+1-th stages of the stator blades 30 are automatically phase-shifted by the angle θ. Thus, excellent assembly can be provided, and occurrence of an error regarding the assembly phase can be reliably prevented.

Various embodiments and variations have been described above, but the present invention is not limited to the contents of these embodiments and variations. Other aspects conceivable within the scope of the technical idea of the present invention are also included in the scope of the present invention.

What is claimed is:

1. A turbo-molecular pump comprising:

multiple stages of rotor blades formed with multiple blades and provided in a rotor axis direction, the multiple blades in each of the multiple stages of the rotor blades being provided at a same equal interval; and multiple stages of stator blades formed with multiple blades, the multiple stages of the stator blades and the multiple stages of the rotor blades being alternately arranged in the rotor axis direction, wherein when m is a positive real number equal to or less than a total number of stages of the rotor blades and greater than one and K is a natural number which is not a multiple of m in a case where m is a natural number and is a natural number in a case where m is not the natural number, the multiple stages of the rotor blades include a stage having a rotor blade at an inter-blade angle $\alpha 1$, and a neighboring stage having a corresponding rotor blade of which reference position is phase-shifted from a reference position of the rotor blade at the inter-blade angle $\alpha 1$ by an angle $\alpha 1 \cdot K/m$.

2. The turbo-molecular pump according to claim 1, wherein when n is a positive real number equal to or less than a total number of stages of the stator blades and greater than one and L is a natural number which is not a multiple of n in a case where n is a natural number and is a natural number in a case where n is not the natural number, the multiple stages of the stator blades include a stage having a stator blade at an inter-blade angle $\alpha 2$, and a neighboring stage having a corresponding stator blade of which reference position is phase-shifted from a reference position of the stator blade at the inter-blade angle $\alpha 2$ by an angle $\alpha 2 \cdot L/n$.

3. A turbo-molecular pump comprising:

multiple stages of rotor blades formed with multiple blades and provided in a rotor axis direction; and multiple stages of stator blades formed with multiple blades, the multiple blades in each of the multiple stages of the stator blades being provided at a same equal interval, and the multiple stages of the stator blades and the multiple stages of the rotor blades being alternately arranged in the rotor axis direction, wherein when n is a positive real number equal to or less than a total number of stages of the stator blades and greater than one and L is a natural number which is not a multiple of n in a case where n is a natural number and is a natural number in a case where n is not the natural number, the multiple stages of the stator blades include a stage having a stator blade at an inter-blade angle $\alpha 2$, and a neighboring stage having a corresponding stator blade of which reference position is phase-shifted from a reference position of the stator blade at the inter-blade angle $\alpha 2$ by an angle $\alpha 2 \cdot L/n$.

4. The turbo-molecular pump according to claim 1, wherein when the total number of stages of the rotor blades is M, a first stage of the rotor blade and a k1-th stage of the rotor blade that (k1−1) is a multiple of m are set as the rotor blade at the inter-blade angle $\alpha 1$, and a k1-th stage of the rotor blade that (k1−1) is not the multiple of m is set as a rotor blade phase-shifted by an angle $\alpha 1$ (k1−1)/m.

5. The turbo-molecular pump according to claim 2, wherein when the total number of stages of the stator blades is N, a first stage of the stator blade and a k2-th stage of the stator blade that (k2−1) is a multiple of n are set as the stator blade at the inter-blade angle $\alpha 2$, and a k2-th stage of the stator blade that (k2−1) is not the multiple of n is set as a stator blade phase-shifted by an angle $\alpha 2$ (k2−1)/n.

6. The turbo-molecular pump according to claim 2, further comprising:

multiple spacer rings provided such that the spacer rings and the multiple stages of the stator blades are alternately stacked on each other in the pump axis direction, wherein each spacer ring has a position adjustment member configured to adjust the reference position of each stator blade.

7. The turbo-molecular pump according to claim 3, wherein when the total number of stages of the stator blades is N, a first stage of the stator blade and a k2-th stage of the stator blade that (k2−1) is a multiple of n are set as the stator blade at the inter-blade angle $\alpha 2$, and a k2-th stage of the stator blade that (k2−1) is not the multiple of n is set as a stator blade phase-shifted by an angle $\alpha 2$ (k2−1)/n.

8. The turbo-molecular pump according to claim 3, further comprising:

multiple spacer rings provided such that the spacer rings and the multiple stages of the stator blades are alternately stacked on each other in the pump axis direction, wherein each spacer ring has a position adjustment member configured to adjust the reference position of each stator blade.

9. A rotor for a turbo-molecular pump, the rotor including the multiple stages of rotor blades formed with multiple blades and provided in a rotor axis direction, the multiple blades in each of the multiple stages of the rotor blades being provided at a same equal interval, wherein when m is a positive real number equal to or less than a total number of stages of the rotor blades and greater than one and K is a natural number which is not a multiple of m in a case where m is a natural number and is a natural number in a case where m is not the natural number, the multiple stages of the rotor blades include a stage having a rotor blade at an inter-blade angle $\alpha 1$, and a neighboring stage having a corresponding rotor blade of which reference position is phase-shifted from a reference position of the rotor blade at the inter-blade angle $\alpha 1$ by an angle $\alpha 1 \cdot K/m$.

10. The rotor according to claim 9, wherein when the total number of stages of the rotor blades is M, a first stage of the rotor blade and a k1-th stage of the rotor blade that (k1−1) is a multiple of m are set as the rotor blade at the inter-blade angle $\alpha 1$, and a k1-th stage of the rotor blade that (k1−1) is not the multiple of m is set as a rotor blade phase-shifted by an angle $\alpha 1$ (k1−1)/m.

11. A stator for a turbo-molecular pump, the stator including multiple stages of stator blades formed with multiple blades, the multiple blades in each of the multiple stages of the stator blades being provided at a same equal interval, wherein when n is a positive real number equal to or less than a total number of stages of the stator blades and greater than one and L is a natural number which is not a multiple of n in a case where n is a natural number and is a natural number in a case where n is not the natural number, the multiple stages of the stator blades include a stage having a stator blade at an inter-blade angle $\alpha 2$, and a neighboring stage having a corresponding stator blade of which reference position is phase-shifted from a reference position of the stator blade at the inter-blade angle $\alpha 2$ by an angle $\alpha 2$ L/n.

12. The stator according to claim 11, wherein when the total number of stages of the stator blades is N, a first stage of the stator blade and a k2-th stage of the stator blade that (k2−1) is a multiple of n are set as the stator blade at the inter-blade angle $\alpha 2$, and a k2-th stage of the stator blade that (k2−1) is not the multiple of n is set as a stator blade phase-shifted by an angle $\alpha 2$ (k2−1)/n.

13. The stator according to claim 11, further comprising:

multiple spacer rings provided such that the spacer rings and the multiple stages of the stator blades are alternately stacked on each other in the pump axis direction, wherein each spacer ring has a position adjustment member configured to adjust the reference position of each stator blade.

* * * * *